US009867755B2

(12) United States Patent
Dalury

(10) Patent No.: US 9,867,755 B2
(45) Date of Patent: Jan. 16, 2018

(54) ERGONOMIC CRUTCH

(76) Inventor: David F. Dalury, Glyndon, MD (US)

( * ) Notice: Subject to any disclaimer, the term of this patent is extended or adjusted under 35 U.S.C. 154(b) by 2029 days.

(21) Appl. No.: 12/589,586

(22) Filed: Oct. 26, 2009

(65) Prior Publication Data

US 2011/0094551 A1 Apr. 28, 2011

(51) Int. Cl.
*A61H 3/02* (2006.01)

(52) U.S. Cl.
CPC ..... *A61H 3/02* (2013.01); *A61H 3/0277* (2013.01); *Y10T 29/49826* (2015.01)

(58) Field of Classification Search
CPC ..... A61H 3/02
USPC ..... 135/65, 68, 71, 72
See application file for complete search history.

(56) References Cited

U.S. PATENT DOCUMENTS 2,568,654 A * 9/1951 Neptune ..... 135/69
2,707,478 A * 5/1955 Davies ..... A61H 3/02 135/73
3,213,870 A * 10/1965 Kiehn ..... 135/68
D204,849 S * 5/1966 Thomas et al. ..... D3/8
4,763,680 A * 8/1988 Acosta, Sr. ..... 135/68
5,495,867 A * 3/1996 Block ..... 135/65
5,725,005 A * 3/1998 Yamasaki et al. ..... 135/73
5,954,074 A 9/1999 Mattson
6,851,438 B2 2/2005 Battiston
7,434,592 B2 10/2008 Larson et al.
2001/0032662 A1* 10/2001 Battiston ..... 135/69
2005/0076941 A1* 4/2005 Larson et al. ..... 135/68
2007/0256718 A1* 11/2007 Diaz ..... 135/72
2008/0006314 A1* 1/2008 Adams ..... 135/65
2008/0163914 A1* 7/2008 Weber et al. ..... 135/68
2008/0223424 A1* 9/2008 Hollier ..... 135/71
2011/0108075 A1* 5/2011 Weber ..... 135/72

* cited by examiner

*Primary Examiner* — David R Dunn
*Assistant Examiner* — Danielle Jackson
(74) *Attorney, Agent, or Firm* — Max Stul Oppenheimer

(57) ABSTRACT

A novel crutch comprising a series of elements angled with respect to each other so as to provide a stable platform for supporting a user's weight while reducing injury.

7 Claims, 5 Drawing Sheets

ERGONOMIC CRUTCH

FIELD AND BACKGROUND OF THE INVENTION

Field of the Invention

The invention is directed to medical devices used to assist walking by helping to support a user's weight. The invention is illustrated with respect to a crutch.

Background Information

Several medical conditions require that a patient reduce the part of his weight which is borne by one or both legs. A common tool for assisting in doing so is the crutch, which conceptually comprises a support designed and angled to fit under a user's axilla (an axillary support) or a support shaped so as to make contact with the ulnar border of the user's forearm (a short-arm support), connected by a shaft to a lower end terminating in a tip designed to contact the ground, with a handgrip intermediate between the two ends and essentially perpendicular to the shaft so as to enable the user to support a portion of his body weight with his arm and shoulder.

In some prior art embodiments, two shafts extend from the axillary support, enclose the handgrip, then taper together and are joined to a single shaft leading to the tip.

It is convenient to describe the orientation of the crutch with respect to the user—for example, forward meaning in the direction the user is facing and outward meaning to the side and away from the user. With these terms defined, the definitions of "backward" "inward" "upward" and "downward" are used in their normal senses.

In the most common embodiments in use, a patient typically positions the axillary support of the crutch below the axilla, pressing it against his ribcage and grips the handgrip, with elbow flexed.

In order to use a pair of crutches to walk while avoiding placing weight on an injured foot, the user stands on the uninjured (weight bearing) foot with a crutch in each hand as just described. The tip of each crutch is placed about six to twelve inches outward and in front of the associated foot. FIG. 3 illustrates this position. The patient then shifts his weight to the crutches, supporting the weight with his arms and swings his body forward between the crutches and transfers his weight to the uninjured foot.

Prior art crutches tend to force the user's arm to be too extended, the orientation of the handgrip forces the user's hand to be radially deviated or flexed and the top of the crutch to dig into the user's chest, all of which are uncomfortable positions and, more specifically, force the user's hand, elbow and shoulder to assume non-anatomic positions for support of weight. Crutches used improperly or for an extended period of time may cause injury to the user's axillary nerves, vessels and tendons resulting from supporting the user's weight, injury to the user's arm or elbow from the stress of maintaining balance or injury to the user's hand or wrist resulting from the stressful position of the user's hand and wrist required to grip conventional handgrips. In addition, because of the anatomy of the axilla, prior art crutches lend themselves to improper use which compresses axillary veins, resulting in swelling of the user's arm.

Prior art attempts to reduce these injuries include padding the axillary or short-arm support and handgrip.

Prior art crutches also encourage an inherently unstable stance. In order to hold a pair of crutches in a strong supporting position, a user tends to hold the upper end of each crutch close against the user's side, providing as a consequence a short distance between the tips of the two crutches, since the crutches extend essentially parallel to the user's side. The distance between the tips may be thought of as the base for supporting the user's weight. If the user holds the upper end of the crutches as described but angles them out so as to increase the distance between the tips in an effort to provide a more stable base, the tips will contact the ground at an angle and be more prone to slipping. This will also lead to the top of the crutch putting pressure on the axilla.

SUMMARY OF THE INVENTION

The foregoing problems are overcome, and other advantages are provided by a novel crutch comprising a series of shaft segments angled with respect to each other in three orthogonal planes at angles selected to honor certain normal anatomical relationships so as to provide a stable platform for supporting a user's weight while reducing injury to and pressure on the user's axillary and carpal nerves, vessel and tendons and the nerves and tendons of the user's elbow. While it would be conceptually possible to make individual measurements of these relationships and design a custom crutch for an individual patient, there are sufficient similarities among patients to allow construction of a small number of generalized crutches, suitable for a wide range of patients, in accordance with the invention. The shaft segments may be discrete segments joined together or may be an integrated as one or more single segments having the described angles. Optionally, the invention may be implemented in a crutch with one or more adjustable components.

It is an object of the invention to provide a crutch which is more comfortable to use and less likely to result in injury than a conventional crutch.

It is a further object of the invention to provide a crutch designed to honor anatomical relationships by angling specific elements of the crutch.

It is a further object of the invention to provide a crutch which encourages a user to hold and use the crutch in an ergonomically correct position.

In one embodiment, it is a further object of the invention to provide a crutch which encourages weight bearing on the user's pectoralis and latissimus muscles rather than the vascular and neural structure of the user's axilla.

It is a further object of the invention to provide a crutch which provides a stable platform while permitting a user to hold the crutch in a comfortable position allowing the upper end of the crutch to be held close to the user's body for strength.

A principal feature of the invention is the angle of the axillary or short-arm support with respect to the lower portion of the crutch and with respect to the user's torso.

Another principal feature of the invention is the angle of the upper portion of the crutch with respect to the lower portion of the crutch.

Another principal feature of the invention is the angle of the handgrip with respect to the lower portion of the crutch.

Among the advantages of the invention are its design which guides its user into a natural ergonomic position, resulting in reduced stress and injury.

A further advantage of this feature of the invention is that, while described herein as a series of angled elements, it can be cast as a unitary piece or as a unitary piece designed to accept an adjustable piece suitable for accommodating the height and arm dimensions of the user.

A further advantage of the invention is that it is use in the same manner as conventional crutches, so a user who is already familiar with the use of prior art crutches may use the invention and obtain its benefits without the disadvantage of needing to learn a new technique.

These and other objects, features and advantages which will be apparent from the discussion which follows are achieved, in accordance with the invention, by providing a novel crutch comprising a series of elements angled with respect to each other in three orthogonal planes at specified angles so as to provide a stable platform for supporting a user's weight while reducing injury to the user's axillary and carpal nerves, vessel and tendons and the nerves and tendons of the user's elbow.

The various features of novelty which characterize the invention are pointed out with particularity in the claims annexed to and forming a part of this disclosure. For a better understanding of the invention, its advantages and objects, reference is made to the accompanying drawings and descriptive matter in which a preferred embodiment of the invention is illustrated.

BRIEF DESCRIPTION OF THE DRAWINGS

The foregoing and still other objects of this invention will become apparent, along with various advantages and features of novelty residing in the present embodiments, from study of the following drawings, in which.

DESCRIPTION OF THE PREFERRED EMBODIMENT

Figure 1:
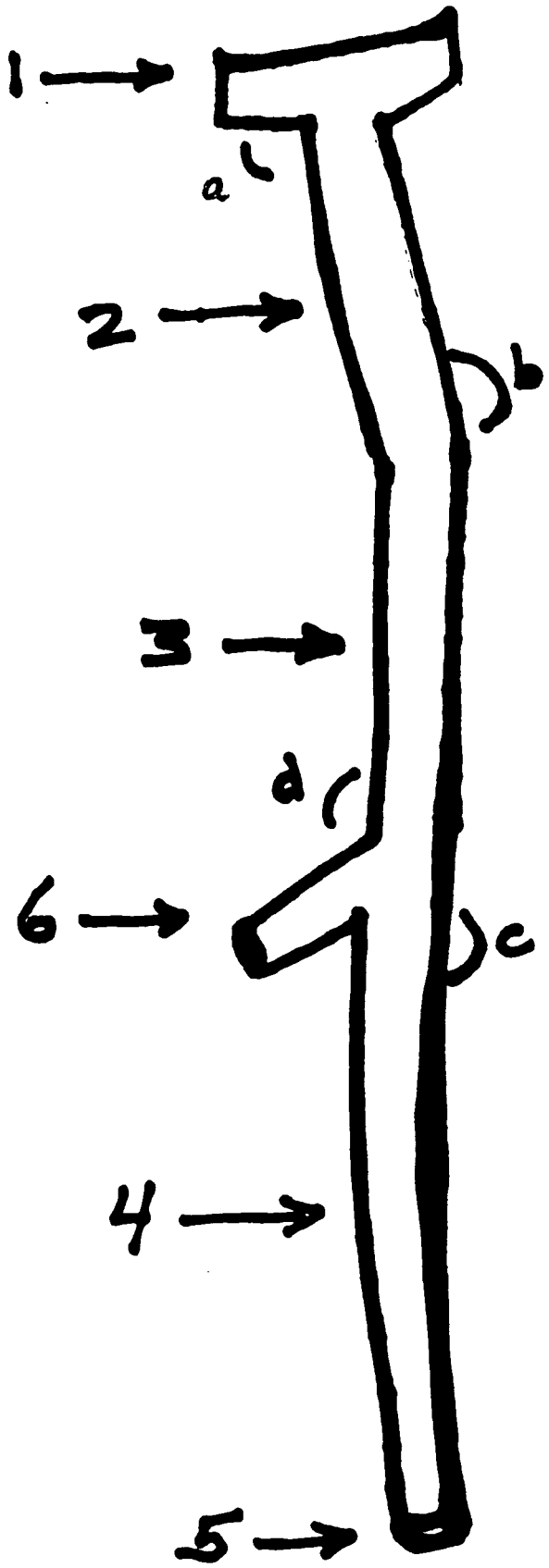
FIG. 1 is a side view of a crutch designed in accordance with the invention.

Referring to the drawings, the invention is a novel crutch comprising a series of elements angled with respect to each other in three orthogonal planes at specified angles or ranges of angles so as to provide a stable platform fOr supporting a user's weight while reducing injury to the user's axillary and carpal nerves and tendons. A first preferred embodiment of the crutch is shown in overview in FIGS. 1 and 2, from several views in FIG. 5, and in use in FIG. 3. A second preferred embodiment is shown in FIG. 4.

Figure 2:
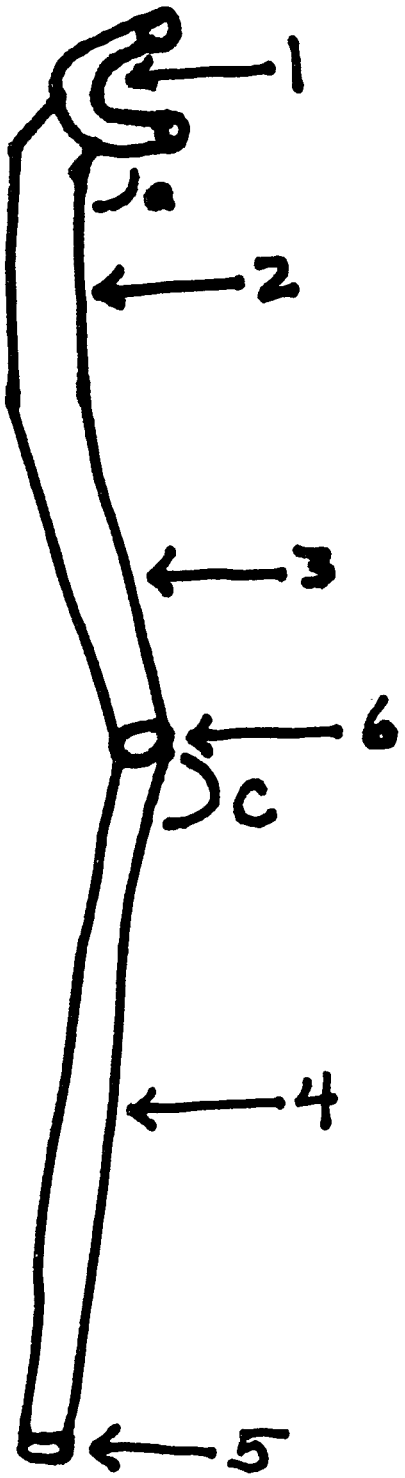
FIG. 2 is a top view of a crutch designed in accordance with the invention.
Figure 3:
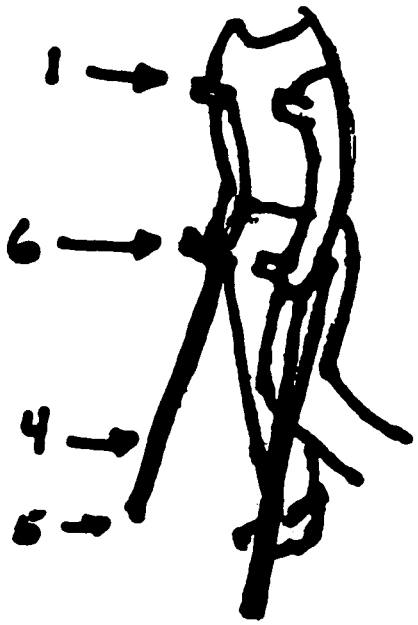
FIG. 3 is a view illustrating a user using a crutch designed in accordance with the invention.
Figure 4:
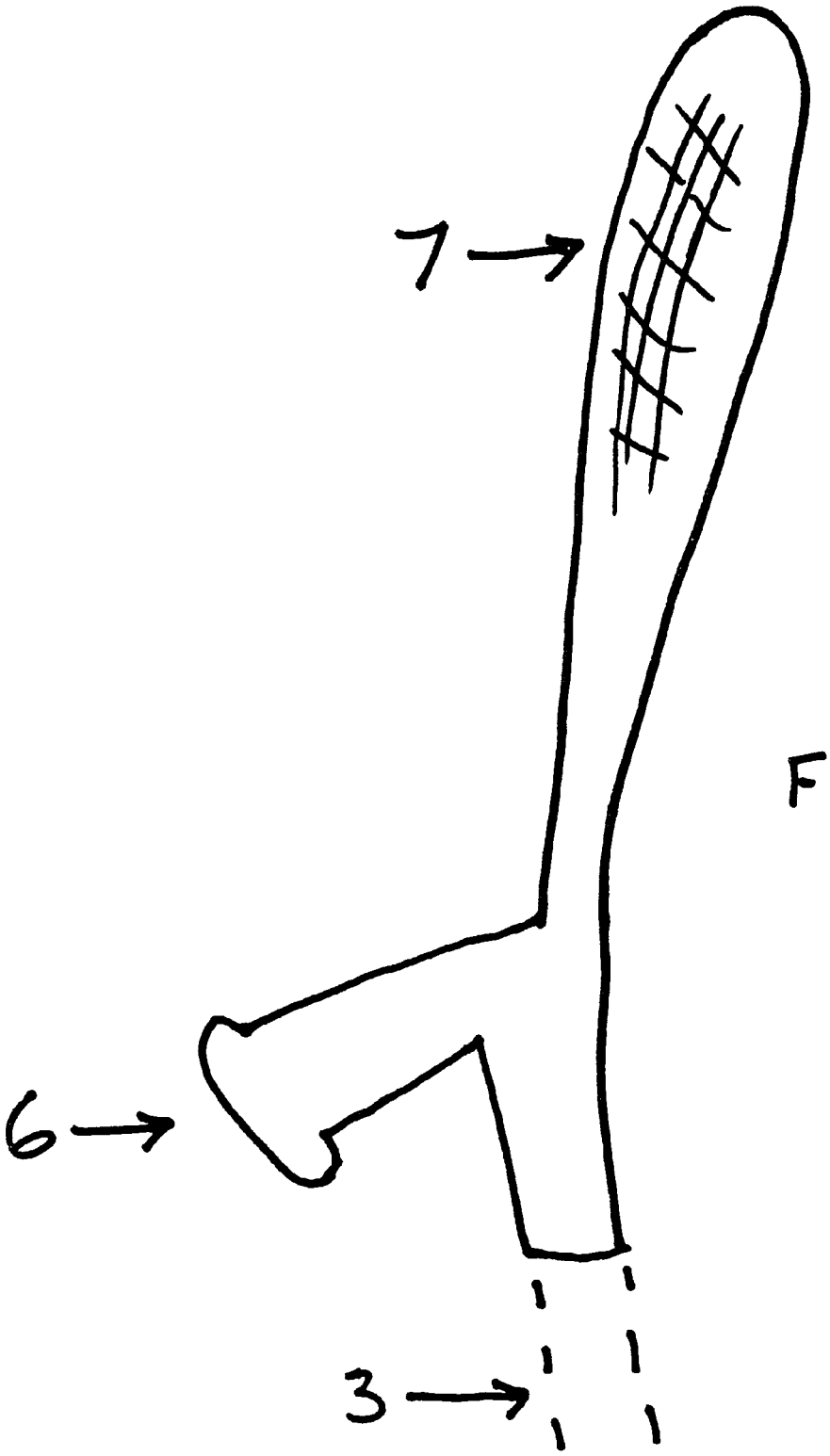
FIG. 4 illustrates the upper segment for an alternate embodiment known as a "short arm crutch."

As illustrated in FIG. 1, the invention comprises a crutch having an axillary support (1) at one end designed and angled to fit under a user's axilla as shown in use in FIG. 3, connected at an angle (a) to an upper shaft segment (2) which in turn is connected at an angle (b) to an intermediate shaft segment (3) which in turn is connected to a lower shaft segment (4) at an angle (c); the lower shaft segment terminates in a tip (5) suitable for making contact with the ground; between the axillary support and the tip, a handgrip (6) joins either the intermediate shaft segment or the lower shaft segment at an angle (d). As best seen in FIG. 2, the axillary support is preferably angled at approximately 10 to 15 degrees toward the user's torso so as to encourage support of the user's weight by the user's pectoralis and latissimus muscles rather than the vascular and neural structure of the user's axilla. It is also contoured front and back so as to decrease pressure on the front and back of the user's axilla. The crutch so constructed enables the user to support a portion of his body weight with his torso and shoulder, arm and hand.

While the invention's construction will be described with respect to assembly of discrete elements attached to each other at specified angles, it will be appreciated that the invention could be constructed by creating the discrete elements then welding or otherwise attaching them together in the described configuration, it could also be implemented by molding or casting the elements as a unitary piece, or various elements could be molded or cast as multiple unified pieces and the resulting unified pieces assembled to produce a crutch with the specified angles. In addition, a crutch could be manufactured of a thermoplastic material or other material capable of being deformed then hardened and the specified angles created in that manner. Optionally, the connection between the handgrip and the shaft segment may be provided with a shock absorbing mechanism to reduce repetitive impact to the user's wrist during use. An example of a suitable such mechanism would be a universal joint provided with springs and a set of stops to prevent overrotation of the handgrip. Optionally, one or more adjustable elements may be incorporated for adjusting to a user's height, arm length, leg length or other characteristic. Other methods of producing a crutch having the specified angles will occur to those of ordinary skill in the art and are encompassed by the invention, which includes the specified configurations regardless of the manner of manufacture.

The preferred lengths of the specified elements and the preferred angles between the elements will vary from user to user. The following describes the technique for determining those lengths and angles for a particular user. The elements could be connected by adjustable means in order to permit producing a crutch which could be customized for a particular user. For example, the elements could be attached to each other using a wing nut which could be loosened in order to establish the desired angle between the elements, then tightened. Alternatively, the elements could be connected by a deformable/settable material, for example a thermoplastic. A range of lengths and angles suitable for wide ranges of users is provided. Instructions are also provided herein which would permit fine-tuning the angles to produce a customized crutch for a specific user.

The basic objective is to provide a crutch which matches the contour of the arm as it flexes forward when it is in a supporting position. The natural position of the arm for strength in supporting weight is pronated relative to the user's ulna at an angle of about 15 to 20 degrees. Prior art crutches force the arm to be too extended, the handle forces the hand to be radially deviated or flexed and therefore does not allow natural pronation, and the top of the crutch will dig into the chest. These are all uncomfortable positions. They force the user's hand, elbow and shoulder to assume non-anatomic positions for support of the user's weight.

In broad concept, the device is a crutch comprising an axillary support, an upper shaft segment having a first end and a second end, an intermediate shaft segment having a first end and a second end, and a lower shaft segment having a first end and a second end; said axillary support connected to the first end of said upper shaft segment at a first angle between the shaft segment and the torso of between approximately 10 and 15 degrees; the second end of said upper shaft segment connected the first end of said intermediate shaft segment.at a second angle of between approximately 15 to 20 degrees outward in the same plane as the first angle and approximately 15 to 20 degrees forward in a plane orthogonal to the plane of said first angle; the second end of said intermediate shaft segment connected to the first end of the lower shaft segment at a third angle of between approximately 20 to 30 degrees outward in a plane orthogonal to the plane of said second angle.

In the first preferred embodiment, the axillary support (1) is contoured to grab the user's thorax from anterior to posterior under the axilla. Optionally, there may be some anterior to posterior contour as well but the main contour is to grab the thorax below the axilla. In order to honor the carrying angle of the elbow, angle (b) is approximately equal to the angle of the user's elbow in the proper carrying position, that is, bent forward approximately 20 to 30 degrees and outward approximately 0 to 20 degrees, and upper shaft segment (2) joins intermediate shaft segment (3) at angle (b) at approximately the user's elbow.

Figure 5:
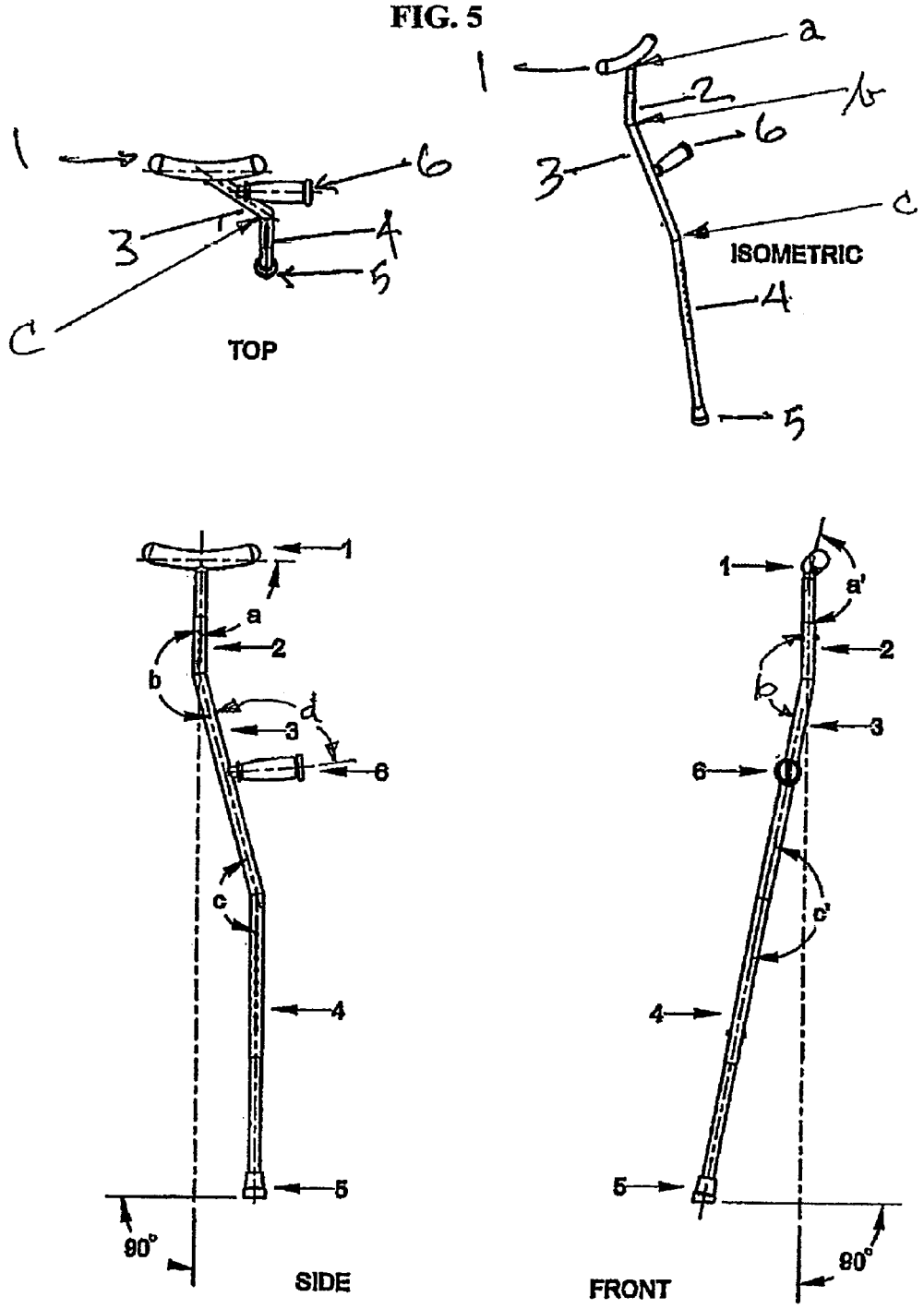
FIG. 5 illustrates an embodiment of the invention from several views.

The various elements and how they are angled relative to each other is also depicted from several different angles in FIG. 5.

To customize a crutch for a particular user, angle (a) should approximate 10 to 15 degrees toward the user's torso (relative to the long axis), and the length of the upper shaft segment should approximate the distance between the user's shoulder and elbow. For most adult male users, 13 to 14.5 inches is a suitable range of values for the length of the upper shaft segment, with a preferred value of approximately 14 inches. For most adult female users, 11 to 13 inches is a suitable range of values for the length of the upper shaft segment, with a preferred value of approximately 12 inches. For pediatric users, the length of the upper shaft segment will depend on the individual user and can be determined using the above customization guidelines.

To customize a crutch for a particular user, angle (b) should approximate the complex angle of the user's elbow in a relaxed carrying position, i.e., approximately 15 to 20 degrees outward (in the sagittal plane) and approximately 15 to 20 degrees forward (in the coronal plane), and the length of the intermediate shaft segment should approximate the distance from the user's elbow to the user's knuckles. For most adult male users, 13 inches to 14.5 inches is a suitable range of values for the length of the intermediate shaft segment, with a preferred value of approximately 13.75 inches. For most adult female users, 11.5 inches to 13 inches is a suitable range of values for the length of the intermediate shaft segment, with a preferred value of approximately 12 inches.

The lower shaft segment of the crutch angles outward at angle (c) to the side away from the midline so as to increase the distance between the crutch tips in use, thereby increasing stability. To customize a crutch for a particular user, angle (c) should be designed to result in a sufficient tip to tip distance to provide a stable platform while allowing the user to maintain the upper end of the crutch close to the torso. A suitable angle for most users would be outward at an angle of about 20 to 30 degrees.

The handgrip is located at approximately 85% to 90% of the distance from the user's axilla to the user's knuckles with the user's arm fully extended; alternatively, the location can be determined by measuring the distance from the user's axilla to the user's hand when the elbow is flexed 15-20 degrees. For most adult males, a suitable range would be within a range of approximately 26 to 29 inches from the axillary support, with a preferred value of approximately 27.5 inches. For most adult females, a suitable range would be within a range of approximately 22 to 26 inches from the axillary support, with a preferred value of approximately 24 inches. The handgrip is ideally slightly internally rotated similarly to the user's forearm, that is about 30-45 degrees pronated and neutral with the 2nd metacarpal of the user's hand lined up longitudinally in parallel to the radius bone of the user's arm, and angled slightly so as to accommodate a normal grip, that is a grip which is pronated at about a 10 degree angle. There should be very little radial deviation of the wrist relative to the forearm. To customize a crutch for a particular user, angle (d) is a complex angle which is largely a matter of user comfort. For most adult users, an angle of 10 degrees upward to 10 degrees downward, with a preferred value of approximately 10 degrees downward, and 0 to 15 degrees inward, with a preferred value of approximately 10 degrees inward is a suitable range of values for angle (d). Likewise, the length of the handgrip is a matter of personal preference, depending largely on the size of the user's hand. Typically, the handgrip would be between 4 and 8 inches. For pediatric users, the angles and dimensions will depend on the individual user and can be determined using the above customization guidelines.

For some applications, an alternate embodiment known as a "short arm crutch" may be preferred. FIG. 4 illustrates the short arm crutch segment, which would replace the axillary support and upper shaft segments of the previously described embodiment, would have an arm support (7) at one end and would connect to the intermediate shaft segment (3) at the other end, and would incorporate a handgrip. The arm support should be of a length and contour that would allow a user's arm to rest comfortably within the support and the handgrip should be located at a position which would allow the user to reach it comfortably. Preferably it would be shaped so as to make contact with the volar surface of a user's forearm muscle belly and the ulnar border of the user's forearm. Cushioning material may be placed on the arm support so as to increase comfort and provide better contact between the arm support and the user's arm. Further sharing of the weight bearing on the volar muscle mass will also be more comfortable for the user. In this embodiment, arm support (7) is connected, in place of axillary support (1) and upper shaft segment (2), to intermediate shaft segment (3); the crutch is the same in all other respects.

For pediatric users, the dimensions depend on the individual user and can be determined using the above customization guidelines.

Optionally, a tip may be connected at the distal end of the crutch, designed to contact the ground. It may be padded or made of a material providing non-slip properties for stability. Stability may also be increased by angling the crutch outward from the user's midline so as to provide a greater base, in which case stability may be further increased by angling the tip outward at an angle of between about 0 and 20 degrees, thereby increasing ground contact.

In a custom application, each of the angles provided may be adjusted within the ranges provided, to a "comfortable" angle in response to the user's subjective evaluation of comfort.

It will be appreciated that other anthropomorphic measurements will be equivalent to the ones described above. For example, calculating the distance from the user's axilla to the user's elbow is equivalent to calculating the user's height at the axilla and subtracting the user's height at the elbow.

The critical dimensions of the invention are summarized in the following chart:

| Element | Custom/Pediatric | Adult Male | Adult Female |
|---|---|---|---|
| Axillary Support (1) | sufficient to provide a bearing surface against the user's torso | 8-10 inches | 8-10 inches |
| Axillary Support (1) to Upper Shaft segment (2) angle (a) | approximately equal to angle of 10 to 15 degrees toward user's torso | approximately equal to angle of 10 to 15 degrees toward user's torso | approximately equal to angle of 10 to 15 degrees toward user's torso |
| Upper Shaft segment (2) | approximately equal to length from user's shoulder to user's elbow | within range of approximately 13 to 14.5 inches; preferred value of approximately 13.75 inches | within range of approximately 11 to 13 inches; preferred value of approximately 12 inches. |
| Upper Shaft segment (2) to Intermediate Shaft segment (3) angle (b) [or in the case of a short-arm crutch, arm support to Intermediate Shaft segment segment angle] | approximately equal to a complex angle of 0 to 10 degrees outward (in the sagittal plane) and approximately 15 to 20 degrees forward | approximately equal to a complex angle of 0 to 10 degrees outward (in the sagittal plane) and approximately 15 to 20 degrees forward | approximately equal to a complex angle of 0 to 10 degrees outward (in the sagittal plane) and approximately 15 to 20 degrees forward |
| Intermediate Shaft segment (3) | approximately equal to length from user's elbow to user's knuckles | within range of approximately 13 to 14.5 inches; preferred value of approximately 13.75 inches | within range of approximately 11.5 to 13 inches; preferred value of approximately 12 inches |
| Intermediate Shaft segment (3) to Lower Shaft segment (4) angle (c) | approximately equal to an angle of 20 to 30 degrees outward (away from the user's midline) | approximately equal to an angle of 20 to 30 degrees outward (away from the user's midline) | approximately equal to an angle of 20 to 30 degrees outward (away from the user's midline) |
| Lower Shaft segment (4) | approximately equal to length from user's elbow to the user's foot | within range of approximately 40 to 47 inches; preferred value of approximately 43.5 inches | within range of approximately 37 to 43 inches; preferred value of approximately 40 inches |
| Handgrip (6) to shaft segment (3 or 4) angle (d) | approximately equal to an angle of 10 degrees upward to 10 degrees downward, with a preferred value of approximately 10 degrees downward, and 0 to 15 degrees inward, with a preferred value of approximately 10 degrees inward | approximately equal to an angle of 10 degrees upward to 10 degrees downward, with a preferred value of approximately 10 degrees downward, and 0 to 15 degrees inward, with a preferred value of approximately 10 degrees inward | approximately equal to an angle of 10 degrees upward to 10 degrees downward, with a preferred value of approximately 10 degrees downward, and 0 to 15 degrees inward, with a preferred value of approximately 10 degrees inward |
| Handgrip (6) | located at a point which allows the user to grip it with elbow slightly bent, typically approximately 85% to 90% of the distance from the user's axilla to the user's knuckles with the user's arm fully extended. Preferably slightly internally rotated similarly to the user's forearm, that is about 30-45 degrees pronated and neutral with the 2nd metacarpal of the user's hand lined up longitudinally in parallel to the radius bone of the user's arm, and angled slightly so as to accommodate a normal | within range of approximately 26 to 29 inches from the axillary support; preferred value of approximately 27.5 inches | within range of approximately 22 to 26 inches from the axillary support; preferred value of approximately 24 inches |

-continued

| Element | Custom/Pediatric | Adult Male | Adult Female |
|---|---|---|---|
| | grip, that is a grip which is pronated at about a 10 degree angle. customize a crutch for a particular user, angle (d) is a complex angle which is largely a matter of user comfort For most adult users, an angle of 10 degrees upward to 10 degrees downward, with a preferred value of approximately 10 degrees downward, and 0 to 15 degrees inward, with a preferred value of approximately 10 degrees inward is a suitable range of values for angle (d). | | |

An alternative embodiment, known as a short-arm crutch, terminates at the upper end of the intermediate shaft segment (3). Such a crutch may be made in accordance with the invention using the dimensions and angles described for all components except the axillary support and upper shaft segment, and providing a suitable support for the user's forearm at the upper end of intermediate shaft segment (3). The top part of the short arm crutch should contact the volar surface of the forearm muscle bellies for support as well as the ulnar border of the forearm. These muscle bellies form a sort of triangular form from the wrist to the elbow and can be used to dissipate the forces of weight bearing. The position of the grip relative to the lower shaft segment of the crutch should be the same as previously described.

The use of the invention is the same as the use of conventional crutches, as previously described. Thus a user who is already familiar with the use of prior art crutches may use the invention and obtain its benefits without the disadvantage of needing to learn a new technique.

Thus, there has been described a novel a crutch comprising a series of shaft segments angled with respect to each other in three orthogonal planes so as to provide a stable platform for supporting a user's weight while reducing injury to the user's axillary and carpal nerves and tendons that has a number of novel features, and a manner of making and using the invention.

While a specific embodiment of the invention has been shown and described in detail to illustrate the application of the principles of the invention, it will be understood that the invention may be embodied otherwise without departing from such principles and that various modifications, alternate constructions, and equivalents will occur to those skilled in the art given the benefit of this disclosure. Thus, the invention is not limited to the specific embodiment described herein, but is defined by the appended claims.

What is claimed is:

1. A crutch comprising an axillary support, an upper shaft segment having a first end and a second end, an intermediate shaft segment having a first end and a second end, and a lower shaft segment having a first end and a second end;

said axillary support connected to the first end of said upper shaft segment at a first angle of between approximately 10 and 15 degrees;

the second end of said upper shaft segment connected to the first end of said intermediate shaft segment at a second angle of between approximately 15 to 20 degrees outward in the same plane as the first angle and approximately 15 to 20 degrees forward in a plane orthogonal to the plane of said first angle;

the second end of said intermediate shaft segment connected to the first end of the lower shaft segment at a third angle of between approximately 20 to 30 degrees outward in a plane orthogonal to the plane of said second angle.

2. A crutch comprising an axillary support, an upper shaft segment having a first end and a 10 second end, an intermediate shaft segment having a first end and a second end, and a lower shaft segment having a first end and a second end;

said axillary support connected to the first end of said upper shaft segment at a first angle of between approximately 10 and 15 degrees;

the second end of said upper shaft segment connected the first end of said intermediate shaft segment at a second angle of between approximately 15 to 20 degrees outward in the same plane as the first angle and approximately 15 to 20 degrees forward in a plane orthogonal to the plane of said first angle.

3. A crutch as in claim 2, further comprising a tip connected at the distal end of said crutch and angled outward at an angle of between about 0 and 20 degrees.

4. A crutch as in claim 1 or 2 or 3, further comprising a handgrip connected to either the intermediate shaft segment or the lower shaft segment at a fourth angle of between approximately 10 degrees upward to 10 degrees downward and 0 to 15 degrees inward.

5. A crutch as in claim 4 wherein said handgrip is padded.

6. A crutch as in claim 1 or 2 or 3 wherein said axillary support is padded.

7. A crutch as in claim 2, further comprising a handgrip connected to either the intermediate shaft segment or the lower shaft segment at a fourth angle of between approximately 10 degrees upward to 10 degrees downward and 0 to 15 degrees inward further comprising a tip connected at the distal end of said crutch and angled outward at an angle of between about 0 and 20 degrees.

* * * * *